US006328048B1

(12) United States Patent
Rivera, Sr.

(10) Patent No.: US 6,328,048 B1
(45) Date of Patent: Dec. 11, 2001

(54) MULTI-USE PATIENT AID

(76) Inventor: Andre B. Rivera, Sr., 3740 NW. 4th St., Ft. Lauderdale, FL (US) 33311

( * ) Notice: Subject to any disclaimer, the term of this patent is extended or adjusted under 35 U.S.C. 154(b) by 0 days.

(21) Appl. No.: 09/605,199

(22) Filed: Jun. 27, 2000

(51) Int. Cl.[7] ..... A45B 3/00; A47G 25/82
(52) U.S. Cl. ..... 135/66; 135/78; 223/118; 223/DIG. 4
(58) Field of Search ..... 135/66, 77, 78; 223/118, DIG. 4

(56) References Cited

U.S. PATENT DOCUMENTS 2,508,104 * 5/1950 Dickensheets ..... 135/66
4,966,316 * 10/1990 George et al. ..... 223/119
5,961,012 * 12/1999 Bucher ..... 223/119

FOREIGN PATENT DOCUMENTS

20203621 * 2/1992 (CA) ..... 135/78

* cited by examiner

*Primary Examiner*—Robert Canfield
(74) *Attorney, Agent, or Firm*—Joseph N. Breaux

(57) ABSTRACT

An aid for movement impaired individuals that converts to function as a cane, a shoe horn and a clothing retrieval hook. The multi-use patient aid includes an adjustable length cane body assembly, a cane foot assembly, an accessory adapter, a shoe horn accessory, and a dressing hook accessory.

1 Claim, 1 Drawing Sheet

MULTI-USE PATIENT AID

TECHNICAL FIELD

The present invention relates to products for assisting movement impaired individuals and more particularly to a multi-use patient aid that includes an adjustable length cane body assembly, a cane foot assembly, an accessory adapter, a shoe horn accessory, and a dressing hook accessory; the adjustable length cane body assembly including a handle member and a cane shaft assembly; the handle member including a handle portion and a tubular shaft connecting portion provided with a number of spaced locking pin receiving apertures provided therethrough; the cane shaft assembly including an elongated shaft portion having a first end provided with a first spring loaded lock pin assembly and a second end provided with a second spring loaded lock pin assembly; the first end being slidably positionable into the tubular shaft connecting portion of the handle member; the cane foot assembly including a tubular foot support and a resilient cane foot attached to a bottom end of the tubular foot support; the tubular foot support having a tubular foot support top end sized to receive therein the second end of the shaft portion and a locking pin receiving aperture provided therethrough for connecting with the second spring loaded lock pin assembly; the accessory adapter including a tubular accessory support having an internally threaded accessory connecting aperture at a bottom end of thereof and a tubular accessory adapter top end sized to receive therein the second end of the shaft portion and a locking pin receiving aperture provided therethrough for connecting with the second end of the shaft portion; the shoe horn accessory including a shoe horn portion having a threaded horn connecting rod extending from a top end thereof, the threaded horn connecting rod being companionately threaded to screw into the internally threaded accessory connecting aperture of the accessory adapter; the dressing hook accessory including a hook portion having a threaded hook connecting rod extending from a top end thereof, the threaded hook connecting rod being companionately threaded to screw into the internally threaded accessory connecting aperture of the accessory adapter.

BACKGROUND ART

Many movement impaired individuals find it difficult to walk without assistance from a cane or the like as well as simple tasks such as putting on shoes and picking up clothing and the like from the floor. It would be a benefit to these individuals to have an aid that could be converted to function as a cane, a shoe horn and a clothing retrieval hook.

GENERAL SUMMARY DISCUSSION OF INVENTION

It is thus an object of the invention to provide a multi-use patient aid that includes an adjustable length cane body assembly, a cane foot assembly, an accessory adapter, a shoe horn accessory, and a dressing hook accessory; the adjustable length cane body assembly including a handle member and a cane shaft assembly; the handle member including a handle portion and a tubular shaft connecting portion provided with a number of spaced locking pin receiving apertures provided therethrough; the cane shaft assembly including an elongated shaft portion having a first end provided with a first spring loaded lock pin assembly and a second end provided with a second spring loaded lock pin assembly; the first end being slidably positionable into the tubular shaft connecting portion of the handle member; the cane foot assembly including a tubular foot support and a resilient cane foot attached to a bottom end of the tubular foot support; the tubular foot support having a tubular foot support top end sized to receive therein the second end of the shaft portion and a locking pin receiving aperture provided therethrough for connecting with the second spring loaded lock pin assembly; the accessory adapter including a tubular accessory support having an internally threaded accessory connecting aperture at a bottom end of thereof and a tubular accessory adapter top end sized to receive therein the second end of the shaft portion and a locking pin receiving aperture provided therethrough for connecting with the second end of the shaft portion; the shoe horn accessory including a shoe horn portion having a threaded horn connecting rod extending from a top end thereof, the threaded horn connecting rod being companionately threaded to screw into the internally threaded accessory connecting aperture of the accessory adapter; the dressing hook accessory including a hook portion having a threaded hook connecting rod extending from a top end thereof, the threaded hook connecting rod being companionately threaded to screw into the internally threaded accessory connecting aperture of the accessory adapter.

Accordingly, a multi-use patient aid is provided. The multi-use patient aid includes an adjustable length cane body assembly, a cane foot assembly, an accessory adapter, a shoe horn accessory, and a dressing hook accessory; the adjustable length cane body assembly including a handle member and a cane shaft assembly; the handle member including a handle portion and a tubular shaft connecting portion provided with a number of spaced locking pin receiving apertures provided therethrough; the cane shaft assembly including an elongated shaft portion having a first end provided with a first spring loaded lock pin assembly and a second end provided with a second spring loaded lock pin assembly; the first end being slidably positionable into the tubular shaft connecting portion of the handle member; the cane foot assembly including a tubular foot support and a resilient cane foot attached to a bottom end of the tubular foot support; the tubular foot support having a tubular foot support top end sized to receive therein the second end of the shaft portion and a locking pin receiving aperture provided therethrough for connecting with the second spring loaded lock pin assembly; the accessory adapter including a tubular accessory support having an internally threaded accessory connecting aperture at a bottom end of thereof and a tubular accessory adapter top end sized to receive therein the second end of the shaft portion and a locking pin receiving aperture provided therethrough for connecting with the second end of the shaft portion; the shoe horn accessory including a shoe horn portion having a threaded horn connecting rod extending from a top end thereof, the threaded horn connecting rod being companionately threaded to screw into the internally threaded accessory connecting aperture of the accessory adapter; the dressing hook accessory including a hook portion having a threaded hook connecting rod extending from a top end thereof, the threaded hook connecting rod being companionately threaded to screw into the internally threaded accessory connecting aperture of the accessory adapter.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
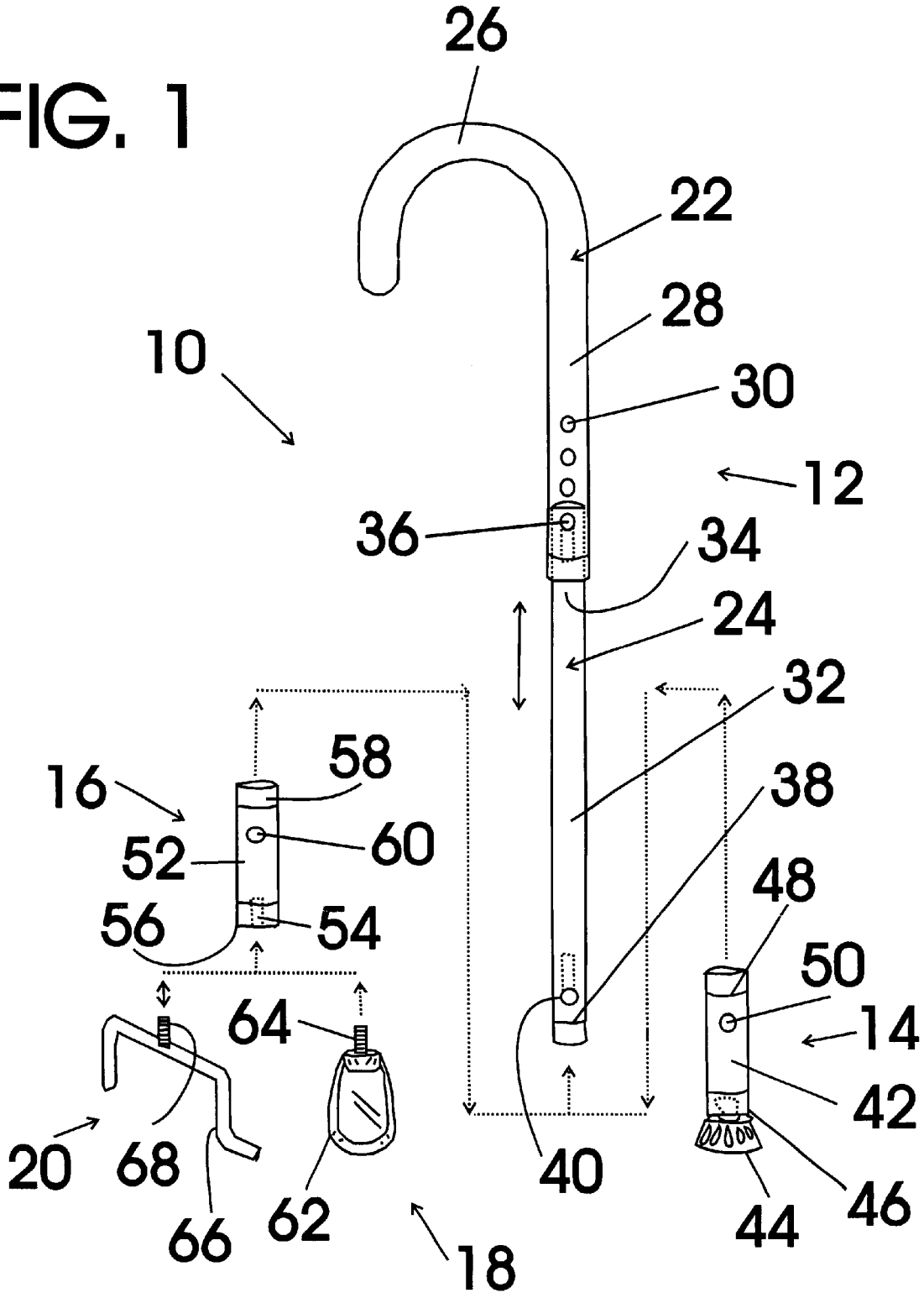
FIG. 1 is an exploded perspective view of an exemplary embodiment of the multi-use patient aid of the present invention showing the adjustable length cane body assembly, the cane foot assembly, the accessory adapter, the shoe horn accessory, and the dressing hook accessory; the adjustable length cane body assembly including a handle member and a cane shaft assembly; the handle member including a handle portion and a tubular shaft connecting portion provided with a number of spaced locking pin receiving apertures provided therethrough; the cane shaft assembly including an elongated shaft portion having a first end provided with a first spring loaded lock pin assembly and a second end provided with a second spring loaded lock pin assembly; the first end being slidably positionable into the tubular shaft connecting portion of the handle member; the cane foot assembly including a tubular foot support and a resilient cane foot attached to a bottom end of the tubular foot support; the tubular foot support having a tubular foot support top end sized to receive therein the second end of the shaft portion and a locking pin receiving aperture provided therethrough for connecting with the second spring load lock pin assembly; the accessory adapter including a tubular accessory support having an internally threaded accessory connecting aperture at a bottom end of thereof and a tubular accessory adapter top end sized to receive therein the second end of the shaft portion and a locking pin receiving aperture provided therethrough for connecting with the second end of the shaft portion; the shoe horn accessory including a shoe horn portion having a threaded horn connecting rod extending from a top end thereof, the threaded horn connecting rod being companionately threaded to screw into the internally threaded accessory connecting aperture of the accessory adapter; the dressing hook accessory including a hook portion having a threaded hook connecting rod extending from a top end thereof, the threaded hook connecting rod being companionately threaded to screw into the internally threaded accessory connecting aperture of the accessory adapter.

FIG. 1 is an exploded perspective view showing various aspects of an exemplary embodiment of the multi-use patient aid of the present invention generally designated 10.

Multi-use patient aid 10 includes an adjustable length cane body assembly, generally designated 12; a cane foot assembly, generally designated 14; an accessory adapter, generally designated 16; a shoe horn accessory, generally designated 18; and a dressing hook accessory, generally designated 20. Adjustable length cane body assembly 12 includes a handle member, generally designated 22, and a cane shaft assembly, generally designated 24.

Handle member 22 includes a curved handle portion 26 and a tubular shaft connecting portion 28. Tubular shaft connecting portion 28 includes a number of spaced locking pin receiving apertures 30 provided therethrough. Cane shaft assembly 24 includes an elongated shaft portion 32 having a first end 34 provided with a first spring loaded lock pin assembly 36 and a second end 38 provided with a second spring loaded lock pin assembly 40. First end 34 is slidably positionable into tubular shaft connecting portion 28 of handle member 22.

Cane foot assembly 14 includes a tubular foot support 42 and a resilient cane foot 44 attached to a bottom end 46 of tubular foot support 42. Tubular foot support 42 has a tubular foot support top end 48 sized to receive therein second end 38 of shaft portion 32 and a locking pin receiving aperture 50 provided therethrough for connecting with second spring loaded lock pin assembly 40.

Accessory adapter 16 includes a tubular accessory support 52 having an internally threaded accessory connecting aperture 54 at a bottom end 56 thereof and a tubular accessory adapter top end 58 sized to receive therein second end 38 of shaft portion 32 and a locking pin receiving aperture 60 provided therethrough for connecting with spring loaded lock pin assembly 40. Shoe horn accessory 18 includes a molded plastic shoe horn portion 62 having a threaded horn connecting rod 64 extending from a top end thereof. Threaded horn connecting rod 64 is companionately threaded to screw into internally threaded accessory connecting aperture 54 of accessory adapter 16. Dressing hook accessory 20 includes a hook portion 66 having a threaded hook connecting rod 68 extending from a top end thereof. Threaded hook connecting rod 68 is companionately threaded to screw into the internally threaded accessory connecting aperture 54 of accessory adapter 16.

It can be seen from the preceding description that a multi-use patient aid has been provided.

It is noted that the embodiment of the multi-use patient aid described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A multi-use patient aid comprising:

an adjustable length cane body assembly;

a cane foot assembly;

an accessory adapter;

a shoe horn accessory; and a dressing hook accessory;

said adjustable length cane body assembly including a handle member and a cane shaft assembly;

said handle member including a handle portion and a tubular shaft connecting portion provided with a number of spaced locking pin receiving apertures provided therethrough;

said cane shaft assembly including an elongated shaft portion having a first end provided with a first spring loaded lock pin assembly and a second end provided with a second spring loaded lock pin assembly;

said first end being slidably positionable into said tubular shaft connecting portion of said handle member;

said cane foot assembly including a tubular foot support and a resilient cane foot attached to a bottom end of said tubular foot support;

said tubular foot support having a tubular foot support top end sized to receive therein said second end of said shaft portion and a locking pin receiving aperture provided therethrough for connecting with said second spring loaded lock pin assembly;

said accessory adapter including a tubular accessory support having an internally threaded accessory connecting aperture at a bottom end of thereof and a tubular accessory adapter top end sized to receive therein said second end of said shaft portion and a locking pin receiving apertures provided therethrough for connecting with said second end of said shaft portion;

said shoe horn accessory including a shoe horn portion having a threaded horn connecting rod extending from a top end thereof, said threaded horn connecting rod being companionately threaded to screw into said internally threaded accessory connecting aperture of said accessory adapter;

said dressing hook accessory including a hook portion having a threaded hook connecting rod extending from a top end thereof, said threaded hook connecting rod being companionately threaded to screw into said internally threaded accessory connecting aperture of said accessory adapter.

* * * * *